US010605552B2

(12) United States Patent
McNitt

(10) Patent No.: US 10,605,552 B2
(45) Date of Patent: Mar. 31, 2020

(54) COMPRESSION FOLLOWER

(71) Applicant: Frank Edward McNitt, Woodland Hills, UT (US)

(72) Inventor: Frank Edward McNitt, Woodland Hills, UT (US)

( * ) Notice: Subject to any disclaimer, the term of this patent is extended or adjusted under 35 U.S.C. 154(b) by 0 days.

(21) Appl. No.: 16/139,706

(22) Filed: Sep. 24, 2018

(65) Prior Publication Data

US 2019/0120582 A1 Apr. 25, 2019

Related U.S. Application Data

(63) Continuation of application No. 15/389,198, filed on Dec. 22, 2016, now Pat. No. 10,082,352, which is a continuation of application No. 14/504,645, filed on Oct. 2, 2014, now Pat. No. 9,534,862.

(60) Provisional application No. 61/885,970, filed on Oct. 2, 2013.

(51) Int. Cl.
*F41A 9/72* (2006.01)
*F41C 7/00* (2006.01)

(52) U.S. Cl.
CPC . *F41A 9/72* (2013.01); *F41C 7/00* (2013.01)

(58) Field of Classification Search
CPC ..... F41A 9/18; F41A 9/70; F41A 9/72
USPC ..... 42/49.01–50
See application file for complete search history.

(56) References Cited

U.S. PATENT DOCUMENTS

| | | | | | |
|---|---|---|---|---|---|
| 14 | A * | 8/1836 | Wilkinson | B24B 27/0076 451/65 |
| 1,350,619 | A | 8/1920 | Payne | |
| 2,909,101 | A * | 10/1959 | Hillberg | F41A 3/32 89/191.02 |
| 3,165,849 | A * | 1/1965 | Into | F41A 9/18 42/17 |
| 3,165,852 | A * | 1/1965 | Into | F41A 9/72 42/49.01 |
| 3,650,060 | A | 3/1972 | Schubert | |
| 3,777,383 | A | 12/1973 | Haines | |
| 3,913,251 | A | 10/1975 | Browning | |
| 4,087,930 | A * | 5/1978 | Grehl | F41A 9/72 42/49.01 |
| 4,310,982 | A * | 1/1982 | Kast | F41A 9/72 42/49.01 |
| 4,821,442 | A * | 4/1989 | Bock | F41A 9/72 42/17 |
| 6,470,614 | B1 * | 10/2002 | Johnson | F41A 9/72 42/17 |

(Continued)

OTHER PUBLICATIONS

U.S. Appl. No. 61/885,970, filed Oct. 2, 2013, McNitt.

(Continued)

*Primary Examiner* — Samir Abdosh
(74) *Attorney, Agent, or Firm* — Ray Quinney & Nebeker P.C.; Paul N. Taylor

(57) ABSTRACT

Implementations of the present disclosure relate to apparatuses, systems, and methods for constructing, installing, and using a compression follower in a tubular firearm magazine. In particular, the compression follower resides inside a shotgun magazine and replaces the standard follower. The compression follower has a compressible tail, thereby providing the capacity of a standard follower and increased reliability by aligning the follower and a magazine spring.

9 Claims, 10 Drawing Sheets

(56) References Cited

U.S. PATENT DOCUMENTS

| | | | | |
|---|---|---|---|---|
| 8,418,393 | B1 * | 4/2013 | Powers | F41A 9/72 42/106 |
| 1,061,787 | A1 | 5/2013 | Simpson | |
| 8,850,731 | B2 * | 10/2014 | Botty | F41A 9/72 42/11 |
| 9,534,862 | B2 | 1/2017 | McNitt | |
| 2013/0091750 | A1 * | 4/2013 | Powers | F41A 9/72 42/49.01 |
| 2014/0075809 | A1 * | 3/2014 | Botty | F41A 9/72 42/49.01 |

OTHER PUBLICATIONS

U.S. Appl. No. 14/504,645, Apr. 18, 2016, Office Action.
U.S. Appl. No. 14/504,645, Jul. 26, 2016, Office Action.
U.S. Appl. No. 14/504,645, Oct. 28, 2016, Notice of Allowance.
U.S. Appl. No. 15/389,198, Oct. 2, 2017, Office Action.
U.S. Appl. No. 15/389,198, Feb. 28, 2018, Office Action.
U.S. Appl. No. 15/389,198, May 24, 2018, Notice of Allowance.

* cited by examiner

COMPRESSION FOLLOWER

CROSS-REFERENCE TO RELATED APPLICATIONS

This application is a continuation of U.S. patent application Ser. No. 15/389,198, filed Dec. 22, 2016, which is a continuation of U.S. patent application Ser. No. 14/504,645, filed Oct. 2, 2014, now U.S. Pat. No. 9,534,862, which claims the benefit of U.S. Provisional Patent Application No. 61/885,970, filed on Oct. 2, 2013, which are hereby incorporated by reference in their entireties.

BACKGROUND OF THE DISCLOSURE

1. The Field of the Disclosure

Generally, this disclosure relates to ammunition management in firearms. More specifically, the present disclosure relates to the delivery of ammunition in a tubular shotgun magazine.

2. Background and Relevant Art

Repeating shotguns, such as automatic, semi-automatic, or pump-action varieties, are commonly provided with a tubular magazine to hold ammunition. The ammunition, known as cartridges or shells, is held in a linear fashion and delivered to the firing chamber of the shotgun sequentially. Typically, a shotgun magazine will hold between 6 and 10 shells at a time, depending on length of the magazine and size of the shells. The shells may be loaded manually into the magazine, with the first shell inserted into the tubular magazine being the final shell to be fed into the firing chamber.

The loading process commonly involves the user pressing a shell against the lifter on the underside of the gun, raising the lifter to expose the rear portion of the tubular magazine, and inserting the shell into the magazine. When the user does so, the shell will press against a magazine follower, which, in turn, presses against a magazine spring. The process is repeated, pushing each shell against the rear of the previous shell until the magazine is full. The magazine spring can expand to run the length of the tubular magazine and provides a motive force urging any shells in the magazine toward the rear of the magazine and, ultimately, the firing chamber. The magazine spring acts on the line of shells via the follower. However, the follower may jam within the tubular magazine and thereby cease feeding shells to the firing chamber. A follower is typically a cylindrical body with an outer diameter that substantially matches an interior diameter of a shotgun's tubular magazine. The follower may jam on debris or dirt in the magazine or simply by rotating. Failures of the follower in the rearward direction can prevent the ammunition from reaching the firing chamber, and therefore, prevent the shotgun from firing. Failures of the follower in the forward direction can prevent a user from loading shells into the magazine, rendering the shotgun inoperable.

In particular, this is of concern in law enforcement or "home defense" applications. A failure of a follower in either situation will render the shotgun inoperable and place the user of the firearm at risk. Because of the adverse environment a user experiences during need of the shotgun, reliability of the firearm is paramount. However, the prior art solution is less than ideal. A "performance follower" of the prior art is largely similar to the standard cylindrical follower, but it has an extension extending toward and within the inner diameter of the magazine spring. This extension acts as a guide to ensure the spring and follower stay in alignment without the spring kinking and/or the follower jamming. The extension, however, increases the length of the follower considerably and reduces the capacity of the magazine. While a more reliable shotgun with one less shell is better than an unreliable shotgun with the full capacity, a more preferable solution would be a follower that increases reliability without adversely affecting capacity.

Thus, there are a number of problems with shotgun magazine followers that can be addressed.

BRIEF SUMMARY OF THE DISCLOSURE

At least one implementation of the present disclosure solve one or more of the foregoing or other problems in the art with the storage and delivery of ammunition in a repeating shotgun.

In one embodiment, a compression follower for use in a tubular shotgun magazine is described. The compression follower has a cylindrical body that can slide within the tubular magazine. The body has a cavity with a spring disposed therein. The body and a tail are compressibly connected by the spring, allowing the tail to compress into the cavity within the body.

In another embodiment, a compression follower for use in a tubular shotgun magazine with a forward end and a rearward end is described. The compression follower has a cylindrical body with an outer diameter substantially matching the interior diameter of the magazine and a tail of smaller diameter extending toward the forward end of the magazine, the tail also fitting within the inner diameter of the magazine spring. The tail and body are compressibly connected, allowing the tail to compress into a cavity within the body.

In another embodiment, a system for improving shotgun performance includes a tubular shotgun magazine having a distal end and a proximal end, a magazine coil spring disposed within the tubular shotgun magazine at the distal end and having an inner diameter, and a follower disposed within the tubular shotgun magazine proximal the magazine coil spring. In some embodiments, the follower of the system for improving shotgun performance includes a cylindrical follower body configured to slide within the tubular magazine, the body having a cavity disposed axially and open at a distal end, a follower spring disposed within the cavity, and a follower tail connected to the body at the distal end of the cavity and extending toward the end of the magazine, the follower tail configured to slide into the cavity when compressed.

In another embodiment, a device for use in a tubular shotgun magazine having a distal end and a proximal end and having a magazine coil spring disposed within the tubular shotgun magazine at the distal end and having an inner diameter includes a cylindrical follower body configured to slide within the tubular magazine, the body having a cavity disposed axially and open at a distal end, a follower spring disposed within the cavity, and a cylindrical follower tail having a diameter less than the inner diameter of the magazine spring and configured to compress the follower spring when pushed into the cavity, the follower tail extending toward the distal end of the magazine.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

One or more implementations of the present disclosure relate to ammunition storage and delivery in firearms. More particularly, one or more implementations of the present disclosure relate to the delivery of shotgun shells from a tubular magazine to a firing chamber by a follower and a magazine spring.

Figure 1:
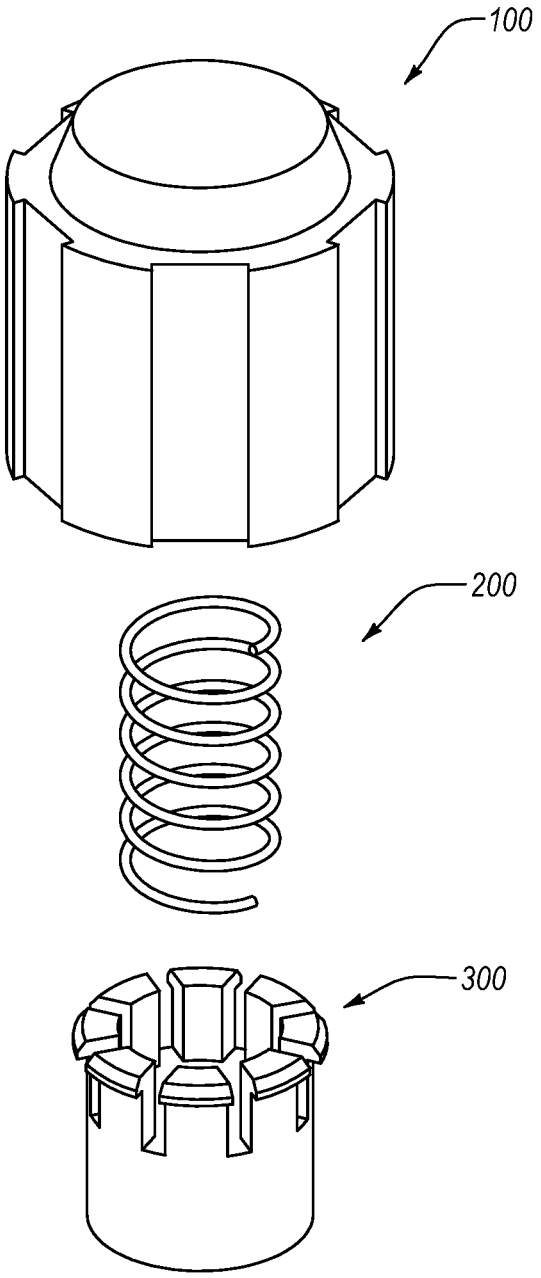
FIG. 1 is an exploded view of an embodiment of a compression follower.

Referring to FIG. 1, a compression follower according to the present disclosure includes, generally, a follower body 100, a spring 200, and a follower tail 300. The follower body 100 may be generally cylindrical in shape with a diameter that substantially matches but is smaller than the diameter of a tubular magazine. The follower body need not be cylindrical, however. The follower body may be an octagon, hexagon, pentagon, or other polygon in cross-section. In the case of a polygonal follower body, the diameter of the circle ascribed by the vertices of the polygon should substantially match but be smaller than the diameter of a tubular magazine. References to "diameter" hereinafter should be understood to encompass polygons ascribing circles of such diameter.

The terms "approximately", "about", and "substantially" as used herein represent an amount close to the stated amount that still performs a desired function or achieves a desired result. For example, the terms "approximately", "about", and "substantially" may refer to an amount that varies within less than 10% of, within less than 5% of, within less than 1% of, within less than 0.1% of, and within less than 0.01% of the stated amount. In the present example, the follower body should have a diameter that closely matches the diameter of the inner wall of the magazine, but may vary dependent on the length of the follower body. More specifically, a longer body is less likely to rotate in the magazine and the diameter of the body may be smaller in relation to the magazine diameter while rotating less, and thereby reducing the chance of ammunition delivery failure. In an embodiment, the ratio of follower body length to follower body diameter ("L-D ratio") is greater than about 1. In another embodiment, the L-D ratio is less than about 1. In yet another embodiment, the L-D ratio is less than about 0.8. In yet another embodiment, the L-D ratio is less than about 0.5.

The compression follower may be adapted to work with a variety of gauges, such as 10, 12, 16, 20, 28, 0.410, or other gauge. An outer diameter of the body may be such that the body can slide freely within the magazine but not turn sideways. The follower body and tail may be made of stainless steel, aluminum, Delrin® and/or any other machinable material. In addition, the follower may include a coating to increase wear resistance and/or decrease friction with the magazine.

Figure 2:
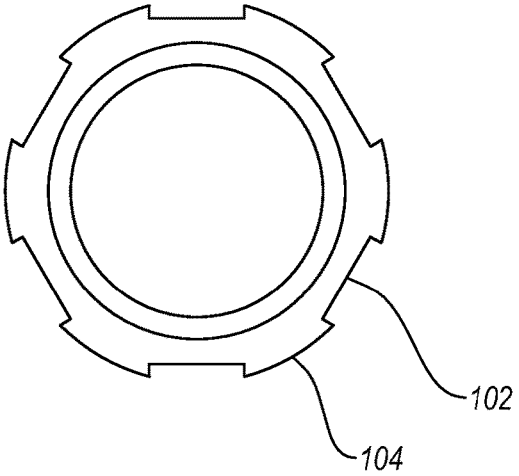
FIG. 2 is a top view of an embodiment of a compression follower body.

Referring now to FIG. 2, shotguns may be used in situations that allow dirt and debris to enter the magazine, either during transport or during the loading process of the firearm. Prior art followers can jam due to debris in the magazine tube lodging between the interior wall of the magazine and the follower. The body may have longitudinal grooves 102 in the outer wall 104 of the body to allow the compression follower to move past debris. In addition, the grooves 102 in the body may accommodate the installation of the compression follower into Remington® stock tubular magazines or similar magazines. The grooves 102 may be flat, stepped, concave, convex, may vary in shape and/or curvature along their length, or may be otherwise shaped.

A compression follower may include additional openings or apertures to reduce the weight of the follower or to aid in machining, tooling, and/or manufacture of the follower. For example, as in the embodiments shown in FIGS. 9 and 10, a follower body 400 may include an opening or aperture at the proximal surface of the proximal end 428.

Figure 3A:
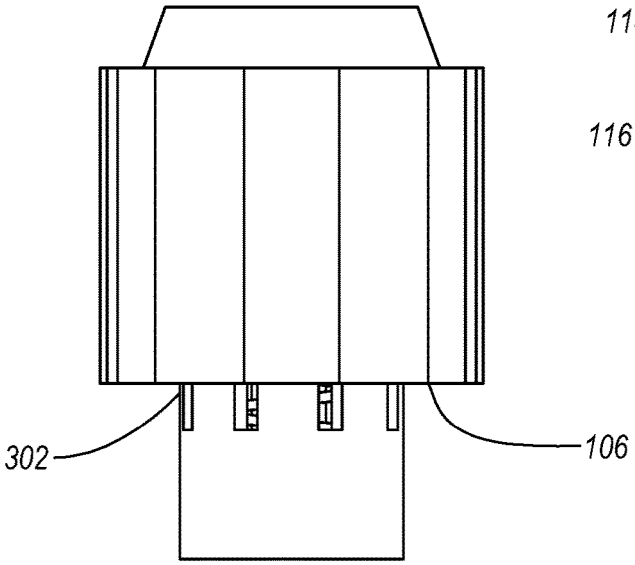
FIG. 3A is a side view of an assembled compression follower according to an embodiment of the present disclosure.

FIG. 3A depicts an assembled compression follower 10. A proximal end 302 of the follower tail may be disposed or partially disposed within a distal end 106 of the follower body, with the spring 200 disposed therebetween.

Figure 3B:
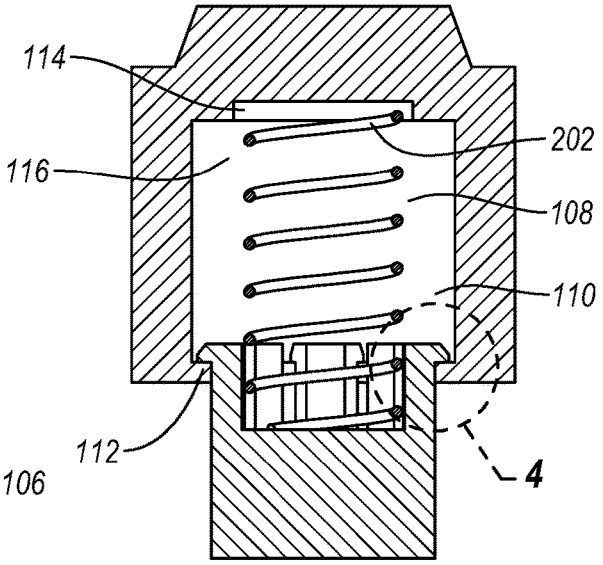
FIG. 3B is a cut-away side view of an assembled compression follower.

As shown in FIG. 3B, the follower body 100 has a cavity 108 that is open at a distal end 110. The distal end 110 of the cavity 108 may have a lip or flange 112. When the follower is assembled, the compression spring 200 may be disposed within the cavity 108 and configured to push the follower body 100 and follower tail 300 apart. In the illustrated embodiment, an expansion force is supplied by a coil spring, but an expansion force may be applied to the follower body 100 and follower tail 300 by other types of springs (e.g., leaf springs), pistons, or other resilient and/or elastic members, expansion devices, or combinations thereof.

A proximal end 202 of the spring may mate with a recess 114 in the cavity 108 to hold the spring 200 in line with the axis of the follower body 100 and tail 300. For example, the spring 200 may be press fit into the recess 114, such that the proximal end 202 of the spring is retained within the recess 114 or there may be a post (not shown) in the proximal end 116 of the cavity 108 configured to retain and align the proximal portion 202 of spring. In other embodiments, a spring may be joined to a cavity of a follower body by adhesives, welding, clamps, pins, or other means of securing a spring in position.

Figure 4:
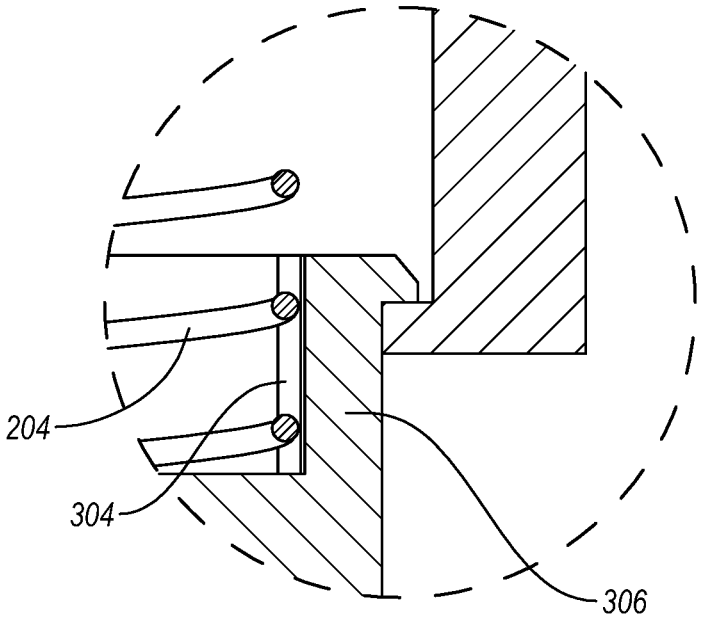
FIG. 4 is a close up of a connection between a follower body and a follower tail.

As shown in FIG. 4, a distal end 204 of the spring 200 may mate with a recess 304 in the follower tail 300. The follower tail 300 may have an outer diameter less than an inner diameter of the cavity 108 in the follower body 100 such that the follower tail 300 may slide into the follower body 100 when the device is compressed. The follower tail 300 may include one or more tabs 306 to enable a press or snap fit between the compression follower body 100 and the compression follower tail 300. For example, the one or more tabs 306 may be configured to engage with or abut against a lip or flange 112 of the follower body 100 to stop further movement of the follower tail 300 as the follower tail 300 is pushed toward the distal end 106 of the follower body by the spring 200 and/or is pushed out of the cavity 108. In other embodiments, other stops may be used in order to maintain the follower tail 300 in position within the follower body 100 and/or to prevent dissociation of the follower tail 300 and follower body 100. For example, pins, braces, latches, snap rings, or a combination of these or other stops may be employed.

The follower tail 300 may also be striated, channeled, fluted, or otherwise slotted to aid in the press or snap fit, as well as reduce the weight of the follower. Reducing the weight of the follower can be advantageous because it reduces the swing weight of the firearm and can improve handling of the firearm. The connection of the tail 300 to the body 100 may also include a threaded cap, clips, or other retention devices or combinations thereof to ensure the tail 300 cannot slide out of the body 100.

Figure 5:
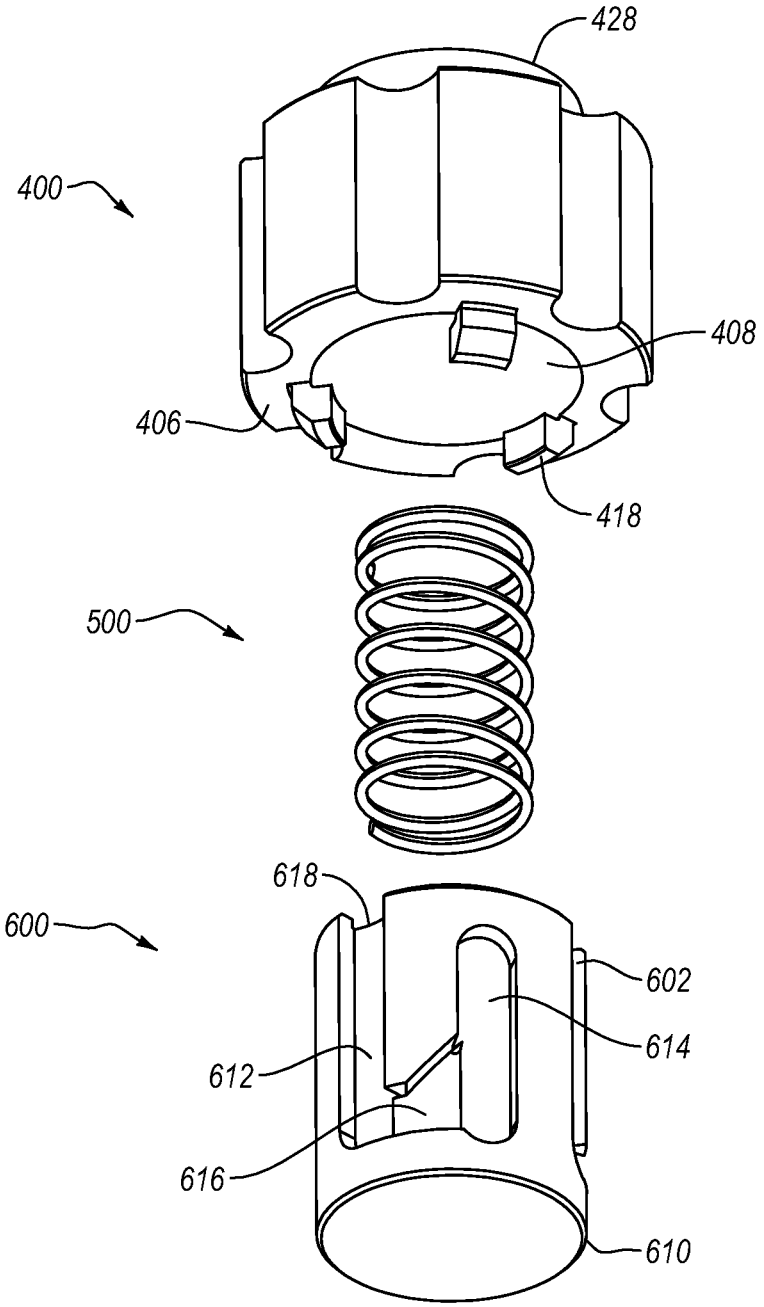
FIG. 5 is an exploded view of another embodiment of a compression follower.
Figure 6:
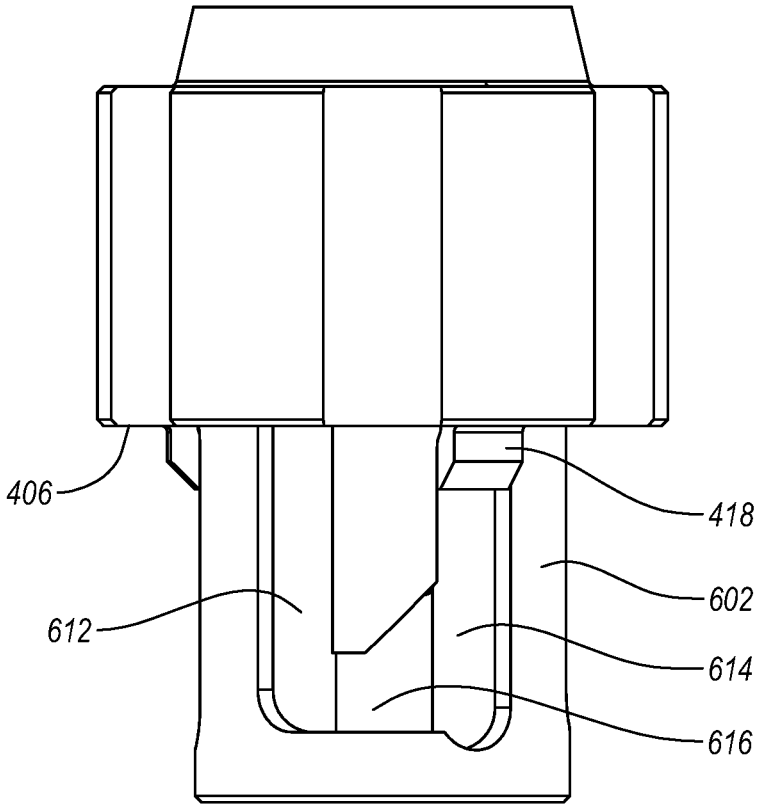
FIG. 6 is a cut-away side view of assembled compression follower according to another embodiment of the present disclosure.

In a particular embodiment, as shown in FIGS. 5 and 6, a compression follower in accordance with the present disclosure may include a follower body 400, a spring 500, and a follower tail 600. FIG. 5 depicts an exploded view of such an embodiment. In the embodiment illustrated in FIG. 5, for example, a follower body 400 includes one or more key members 418 extending from a distal surface of the follower body 400 (see also FIG. 9). The one or more key members 418 may be uniform in size and shape and may be equally radially spaced along the distal end 406 of the follower body 400, as shown in FIGS. 5 and 6. In other embodiments, one or more key members may not be evenly radially spaced, or may be non-uniform in size and shape. The one or more key members 418 preferably extend a distance radially inward from the distal end 406 of the follower body 400, and are configured to fit into and mate with one or more keyways 612 included in a follower tail 600.

The follower tail 600 may include one or more keyways 612 configured to receive the one or more key members 418 of the follower body 400. For example, a keyway 612 may include an opening 618 at the proximal end 602 of the follower tail 600 such that the keyway 612 extends all the way through the proximal end 602 of the follower tail 600, and such that a key member 418 may be inserted into the keyway 612 at the keyway opening 618. A keyway 612 may also include a locking section 614 configured to maintain the position of a key member 418 within the locking section 614 and away from an opening 618 in the keyway 612. For example, a keyway 612 may extend toward a distal end 610 of the follower tail 600 before turning or angling around at an angled section 616 and extending back toward the proximal end 602 of the follower tail 600 to define a locking section 614. A locking section 614 of a key member 612 does not extend fully through the proximal end 602 of the follower tail 600, such that a key member 418 within the locking section 614 cannot pass through the proximal end 602 of the follower tail 600 without passing back through the angled section 616 and out of the keyway opening 618.

FIG. 6 illustrates an assembled compression follower. The proximal end 602 of the follower tail 600 may be disposed or partially disposed within a distal end 406 of the follower body 400, with the spring 500 disposed between the follower body 400 and follower tail 600. The follower tail 600 may have an outer diameter less than an inner diameter of a cavity 408 of the follower body 400 such that the follower tail 600 may slide into the follower body 400 when the device is compressed. When such a compression follower is assembled, the compression spring 500 may be disposed within the cavity 408 of the follower body 400 and configured to push the follower body 400 and follower tail 600 apart. For example, a spring 500 may be joined to the follower body 400 and/or follower tail 600 by press fitting into a recess of the follower body 400 and/or a recess of the follower tail 600, as described above in relation to other embodiments (see, e.g., FIGS. 3B and 4).

In the particular embodiment shown in FIGS. 5 and 6, the follower body 400 may be joined to the follower tail 600 by inserting one or more key members 418 of the follower body 400 into the one or more keyways 612 configured for receiving the corresponding one or more key members 418. The follower body 400 and the follower tail 600 may then be positioned relative to one another (e.g., rotated) such that the one or more key members 418 pass through the one or more angled sections 616 and are positioned within the one or more locking sections 614. In this configuration, the spring 500 may force the follower body 400 and the follower tail 600 apart, and as the device compresses and expands, the follower body 400 will remain joined to the follower tail 600 by the position of the one or more key members 418 within the locking section(s) 614 of the one or more keyways 612.

Figure 7:
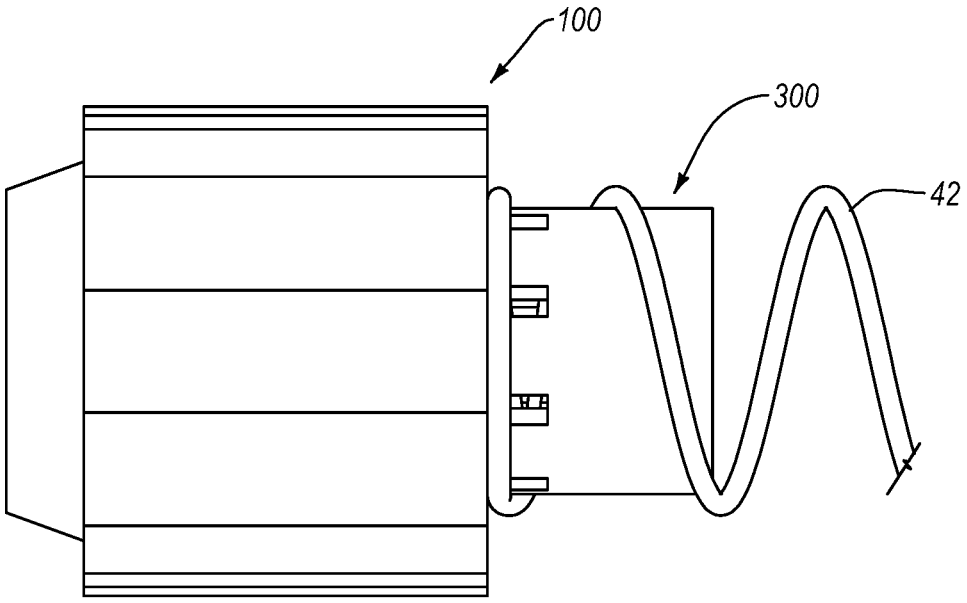
FIG. 7 is a side view of the interface between a compression follower tail and a magazine spring.

As shown in FIG. 7, the outer diameter of the follower tail 300 may also be less than that of an inner diameter of a magazine spring 42 to enable the tail 300 to extend through the center of the magazine spring 42, thereby encouraging axially aligned compression and expansion of the magazine spring 42 and aligning the compression follower 10 axially within the magazine. In one embodiment, the ratio of follower body length to follower tail length ("B-T ratio") is less than about 1. In another embodiment, the B-T ratio is greater than about 1. In yet another embodiment, the B-T ratio is greater than about 1.5. In yet another embodiment, the B-T ratio is greater than about 2. In yet another embodiment, the B-T ratio is greater than about 3.

The follower tail 300 may also be tapered toward a distal end to more reliably expand into the magazine spring 42 without catching on the coils. The tail 300 may alternatively include a plurality of pieces of decreasing diameter joined in a manner similar to the way in which any of the components of the other embodiments are joined, as previously described (e.g., in a manner similar to the way in which the tail 300 is connected to the body 100), to create a telescoping tail. In an extended state, the plurality of pieces may be extended by the spring 200. The plurality of pieces may be connected as described above in relation to connecting a follower body to a follower tail (e.g., using a snap or press fit with a lip or flange or by locking keyways or by other retention devices or combination thereof). In a compressed state, the plurality of pieces would each slide into the cavity 108 in an axially aligned, concentric relationship. A telescoping tail would enable longer extension and, in addition, would intrinsically include the advantageous tapering of the tail previously mentioned.

Figure 8A:
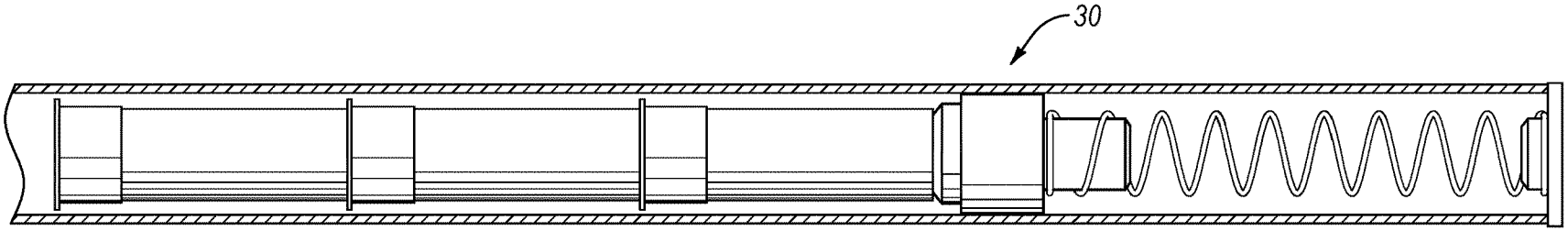
FIG. 8A is a cut-away view of a prior art follower in use.
Figure 8B:
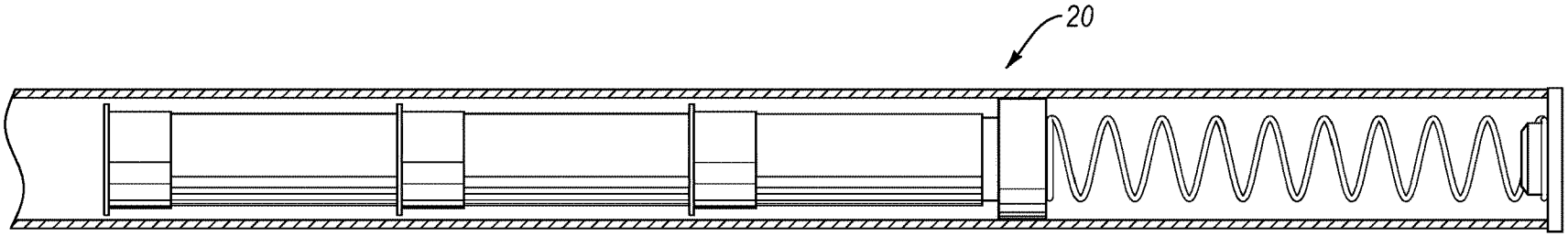
FIGS. 8B-8C is a cut-away view of an embodiment of a compression follower in use.
Figure 8C:
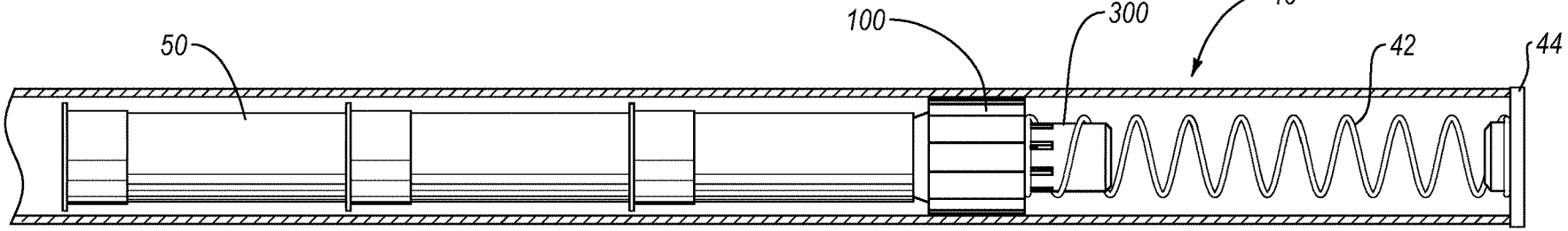

Referring to FIGS. 8A-8C, a compression follower 10 (shown compressed in FIG. 8B and expanded in FIG. 8C) may replace a standard follower 20 (shown in FIG. 8A) in a tubular magazine 40. The compression follower 10 is disposed within the tubular magazine 40 in an expanded form, similar to the prior art "performance follower" 30 with a rigid follower tail, until the magazine 40 is loaded to capacity. As shells 50 are loaded into the magazine 40, the shells 50 may push against the follower body 100, and the follower body 100, in turn, may push against and compress the magazine spring 42.

Figure 8D:
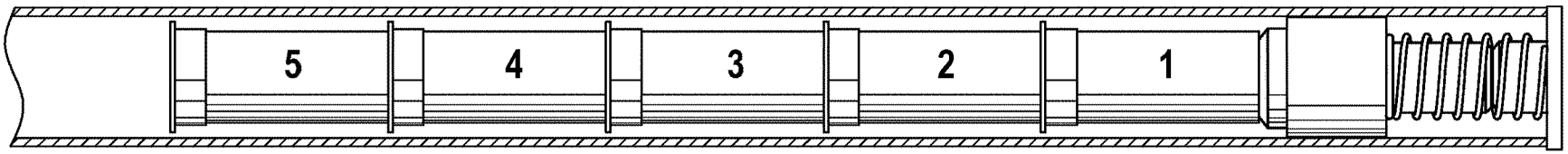
FIG. 8D is a cut-away view of a prior art follower in use at the maximum capacity of a tubular magazine.
Figure 8E:
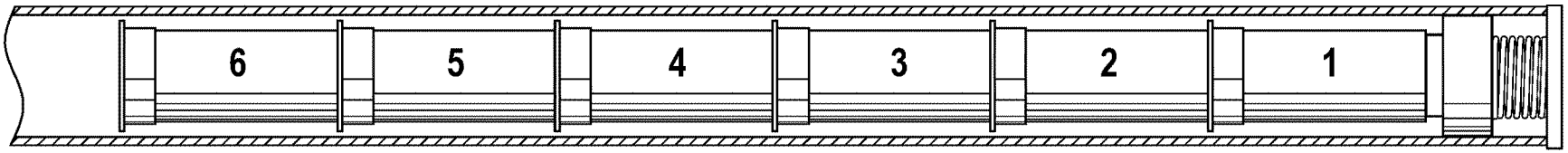
FIGS. 8E-8F is a cut-away view of an embodiment of a compression follower in use at the maximum capacity of a tubular magazine.
Figure 8F:
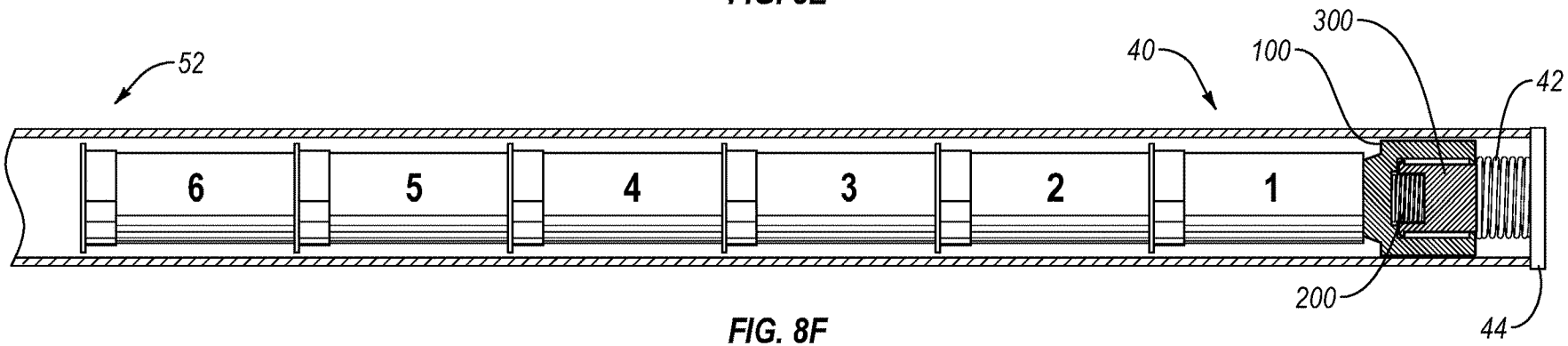

As can be seen in FIGS. 8D-8F, upon insertion of the final shell 52 into the magazine 40, the follower tail 300 may contact a magazine cap 44 or other end of the magazine 40. However, upon contacting the end of the magazine 44, the compression follower tail 300 may slide into the compression follower body 100, compressing to the size of the prior art "standard follower" 20 and allowing the full magazine capacity. The tail 300 need not compress fully into the follower body 100, but only enough to permit loading of the full capacity of the magazine.

Likewise, the compression follower 10 operates to expand upon delivery of a first shell from the magazine to the firing chamber. When the first (final loaded) shell is delivered to the firing chamber and the line of ammunition moves away from the forward end of the magazine, the compression follower spring 200 expands and the compression follower tail 300 extends. Upon extension, the tail slides into the inner diameter of the magazine spring 42, and the configuration returns to that of FIGS. 8A-8C.

Figure 9:
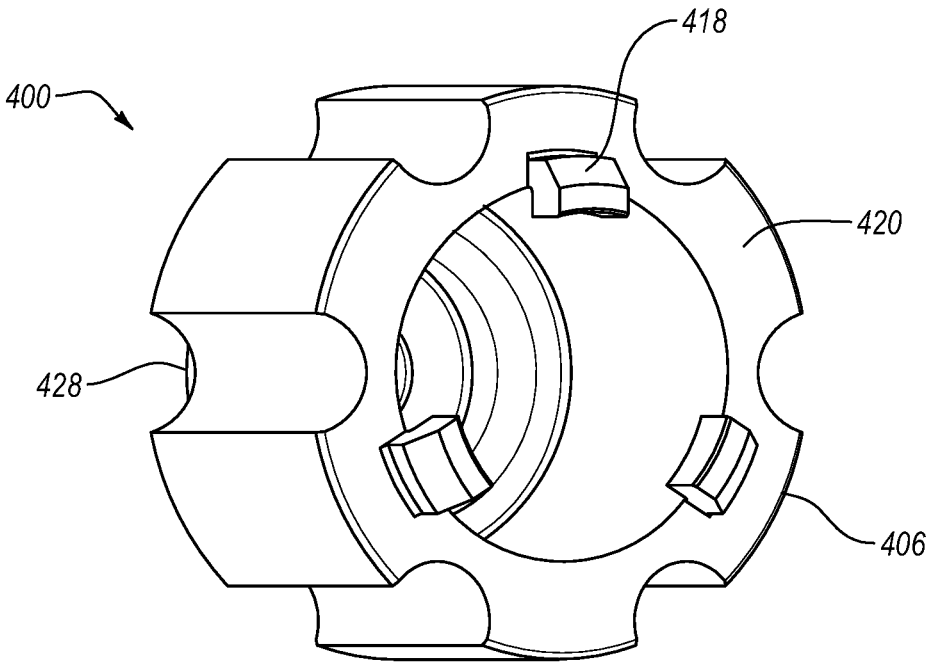
FIG. 9 is an isometric view of another embodiment of a compression follower body.
Figure 10A:
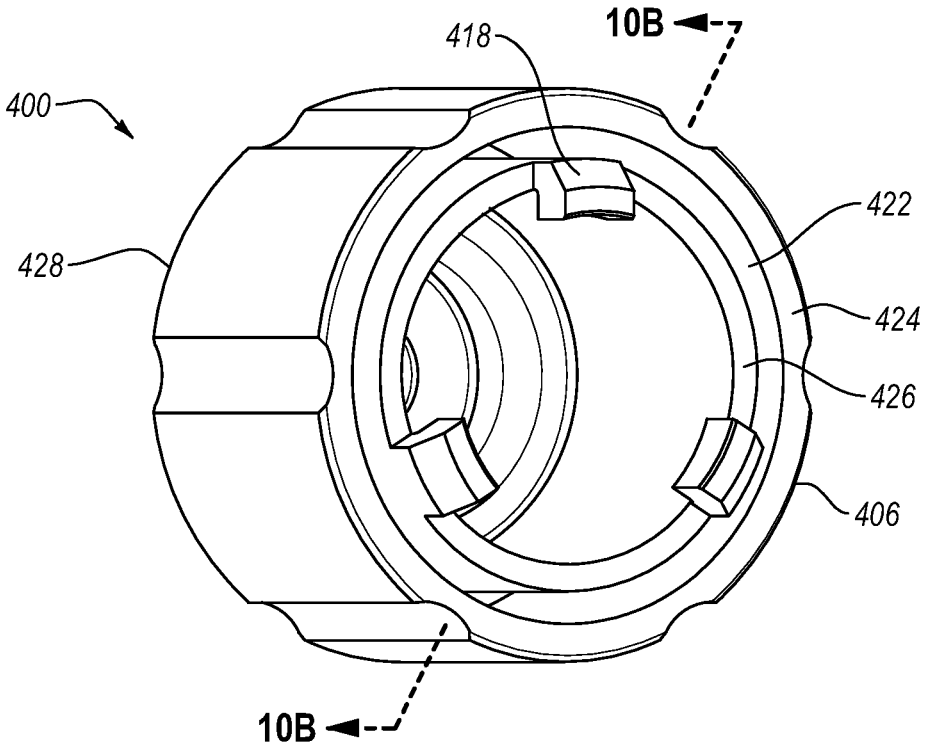
FIG. 10A is an isometric view of another embodiment of a compression follower body including a receptacle area.
Figure 10B:
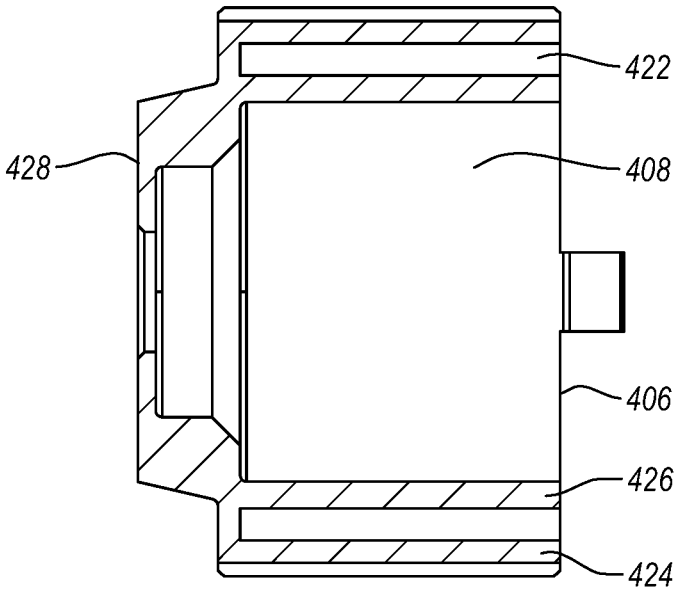
FIG. 10B is a cut-away side view of a compression follower body including a receptacle area.

FIG. 9 illustrates another view of an embodiment of a follower body 400 according to the present disclosure. In the embodiment shown in FIG. 9, the distal end 406 of the follower body 400 includes a collar section 420 that is substantially solid (e.g., is substantially free of cutouts, voids, etc.). In other embodiments, the collar section 420 may not be substantially flat and/or substantially solid. In the embodiment illustrated in FIGS. 10A and 10B, for example, the collar section 420 includes a circumferential cutaway or recess (e.g., a trepan cut), extending from the distal end 406 of the follower body 400 a distance toward a proximal end 428 of the follower body 400, thereby forming a receptacle area 422 disposed between an outer collar 424 and an inner collar 426 of the follower body 400.

The cutaway or recess forming the receptacle area 422 may extend from the distal end 406 of the follower body 400 to the proximal end 428 of the follower body 400 without passing completely through the proximal end 428. For example, the receptacle area 422 may be as deep as possible while still maintaining the structural integrity of the follower body 400, such as extending through about 80% or more of the length of the follower body 400. Alternatively, the cutaway or recess forming the receptacle area 422 may extend only partially through the length of the follower body 400, such as extending through less than about 80% of the length in some embodiments, or less than about 65% in other embodiments. In other embodiments, the receptacle area 422 may extend less than about 50% or even less than about 35%. In yet other embodiments, the receptacle area 422 may extend through about 20% of the length of the follower body 400 or less.

Figure 11A:
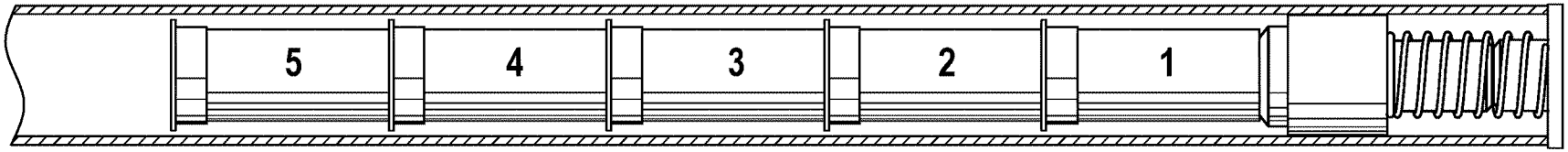
FIG. 11A is a cut-away view of a prior art follower in use.
Figure 11B:
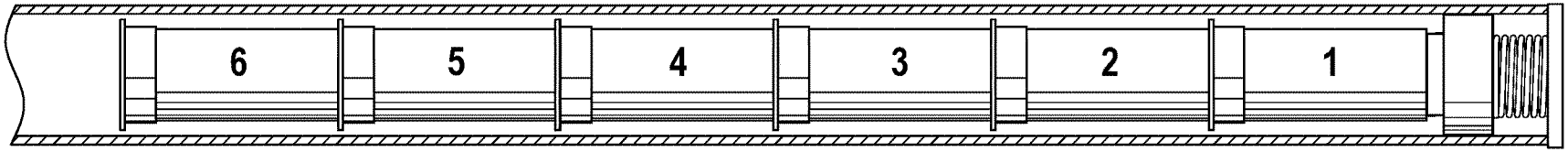
FIGS. 11B-11C is a cut-away view of another embodiment of a compression follower in use at the maximum capacity of a tubular magazine.
Figure 11C:
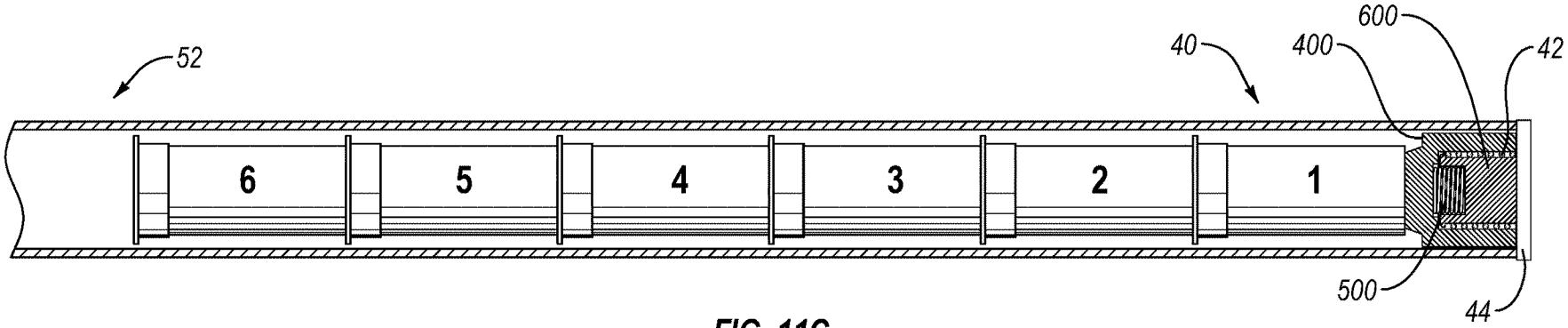

FIGS. 11A-11C illustrate a compression follower (shown compressed in FIG. 11B and expanded in FIG. 11C) that may replace a standard follower (shown in FIG. 11A) in a tubular magazine. An embodiment of a compression follower may include a follower body 400 including a receptacle area 422 configured to receive a magazine spring 42 or portion thereof. As described above in relation to FIGS. 8A and 8B, as shells 50 are loaded into the magazine 40, the shells 50 push against the follower body 400, and the follower body 400, in turn, may push against and compress the magazine spring 42. Upon insertion of the final shell 52 into the magazine 40, the follower tail 600 may contact a magazine cap 44 or other end of the magazine 40, whereupon the follower tail 600 may slide into the follower body 400, compressing the length of the compression follower device. In the particular embodiment shown in FIG. 11, the magazine spring 42 may also enter and be positioned within the receptacle area 422 of the follower body 400 and/or may be secured or attached therein. In some embodiments, this may allow further compression of space within the magazine 40 and ability to reach full magazine capacity.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope. Additionally, any combination of the featured disclosed in any of the foregoing embodiments can be combined, such that components and elements from one embodiment may be incorporated into and/or replace elements from any of the other embodiments described herein.

What is claimed is:

1. A device for use in a shotgun magazine, the device comprising:

a follower body configured to slide within a tubular magazine, the body having a cavity;

a follower tail connected to the body and configured to slide into the body wherein the maximum length of follower body and the maximum outer diameter of the follower body have a ratio less than 1; and an expansion device disposed in the cavity between the body and the tail, and configured to apply an expansion force between the body and the tail.

2. The device of claim 1, wherein the follower tail comprises a plurality of concentric sections.

3. The device of claim 1, wherein the maximum length of follower body and the maximum outer diameter of the follower body have a ratio less than 0.8.

4. The device of claim 1, wherein the maximum length of follower body and the maximum outer diameter of the follower body have a ratio less than 0.5.

5. The device of claim 1, wherein the length of follower body and length of the follower tail have a ratio greater than 1.

6. The device of claim 1, wherein the length of follower body and length of the follower tail have a ratio greater than 1.5.

7. The device of claim 1, wherein the length of follower body and length of the follower tail have a ratio greater than 2.

8. The device of claim 1, wherein the length of follower body and length of the follower tail have a ratio greater than 3.

9. The device of claim 1, wherein the follower body further comprises a plurality of longitudinal grooves on an outer surface.

* * * * *